United States Patent [19]

Clevinger

[11] 4,408,513

[45] Oct. 11, 1983

[54] DUAL SIGNAL MAGNETIC PICKUP WITH EVEN RESPONSE OF STRINGS OF DIFFERENT DIAMETERS

[76] Inventor: Martin R. Clevinger, 5410 Telegraph Ave. #4, Oakland, Calif. 94609

[21] Appl. No.: 360,181

[22] Filed: Mar. 22, 1982

[51] Int. Cl.[3] ..... G10H 1/08; G10H 3/18

[52] U.S. Cl. ..... 84/1.15; 84/1.16; 84/1.22

[58] Field of Search ..... 84/1.15, 1.16, 1.22

[56] References Cited

U.S. PATENT DOCUMENTS

| | | | |
|---|---|---|---|
| 3,249,677 | 5/1966 | Burns et al. | 84/1.16 |
| 3,541,219 | 11/1970 | Abair | 84/1.15 |
| 3,588,311 | 6/1971 | Zoller | 84/1.15 |
| 3,668,295 | 6/1972 | Broussard | 84/1.15 |
| 4,026,178 | 5/1977 | Fuller | 84/1.16 |
| 4,133,243 | 1/1979 | DiMarzio | 84/1.15 |
| 4,220,069 | 9/1980 | Fender | 84/1.15 |
| 4,222,301 | 9/1980 | Valdez | 84/1.15 |
| 4,269,103 | 5/1981 | Underwood | 84/1.16 |
| 4,364,295 | 12/1982 | Stich | 84/1.15 |
| 4,372,186 | 2/1983 | Aaroe | 84/1.15 |

*Primary Examiner*—Stanley J. Witkowski

*Attorney, Agent, or Firm*—Limbach, Limbach & Sutton

[57] ABSTRACT

A transducer adapted to fretless musical instruments, instruments with non-conductive frets or non-conductive string wrapping, with two or more vibratable strings of magnetically permeable material. The strings pass through a magnetic field. Motion of the strings generates current in the strings, as well as in coils placed within the common magnetic field. Means are provided to passively mix both signals generated in the coil and signals generated in the strings. The circuitry electrically connected to the strings incorporates a method of balancing the uneven output caused by differences in string diameter. There is no special "return" wiring of the neck required. A wide variety of tonal differences are obtainable without active circuitry or signal processing. The signal level and impedance is such that it can be connected through a convenient length of cable to a standard musical instrument amplifier.

32 Claims, 8 Drawing Figures

| FIG. 5a | FIG. 5b |
|---|---|

DUAL SIGNAL MAGNETIC PICKUP WITH EVEN RESPONSE OF STRINGS OF DIFFERENT DIAMETERS

BACKGROUND OF THE INVENTION

This invention relates, generally, to conversion of physical motion into electrical signals, and more particularly to a magnetic pickup for stringed musical instruments which are fretless or which have non-conductive, high resistance frets or non-conductive string wrappings. The invention involves two different methods of generating an audio signal within a single magnetic circuit. The invention can be applied to any fretless metal string instrument having at least two strings. Among such possible applications are the violin, viola, cello, and the double bass. A fretless electric bass is one such instrument for which the invention is well suited.

Variable reluctance pickups of the prior art have become the established method of converting string motion into audio signals; the tonality and "touch response" of the electric bass are due largely to the characteristics of the pickup used. One major disadvantage of prior art variable reluctance pickups is found in those pickups having separate pole pieces or separate magnets dedicated to each string which results in small magnetic fields associated with each string. When the strings are plucked, their motion can exceed the area of the magnetic field, thus causing loss of signal.

When a string is plucked, the player first draws the string out of its restive position, then releases it. Acoustically, the initial attack furnishes a percussive quality and presence. Unfortunately, this initial acoustical vibration cannot typically be converted into an audio signal by conventional variable reluctance pickups. In the large coils of prior art variable reluctance pick-ups the generation of an audio signal in response to the initial attack is delayed due to an opposition to current flow in the coil from the induced electromotive force being generated in the coil.

In prior art variable reluctance pickups, in order to passively drive a length of cable and to match the standard amplifier input impedance, as is required in normal operation of electric stringed instruments, the desired output level is achieved by using a coil having many turns of fine copper wire. The resulting coil has a high impedance. As a result, interference can more easily couple into the pick-up signal path. Additionally, high frequencies are attenuated by the combination of this high impedance and the capacitance and inductance of the coils. Furthermore, the coils often have a resonance within the audio frequency range which causes frequency response peaks in the output signal. These characteristics combine to give a "tonal character" to the pickup. Efforts to reduce the high impedance of the coils, in order to increase their high frequency range or to equalize their response, have required the use of bulky and complex active circuitry in close association with the coils to amplify the signal levels before transmission to a musical instrument amplifier.

Yet, another disadvantage of the prior art variable reluctance pickups is their sensitivity to the proximity of the strings. A 1/32 inch difference in pick-up to string distance can make as much as 30% difference in output level. During the course of playing, these distances will change as the player stops the strings in high and low playing positions. Notes from strings in a high position will appear to leap out at excessive levels while notes from strings in a low position will drop out, all due to the difference in distance of each string from the pickup.

In spite of its disadvantages, however, the variable reluctance pickup is standard on electric basses. Almost all the music played today employs electric basses equipped with variable reluctance pickups. These pickups provide clarity in T.V. and radio broadcasts, as well as in large concert halls. Representative of such variable reluctance pickups are those disclosed in U.S. Pat. Nos. 3,018,682 to Les Paul; 3,035,472 to Freeman; 3,066,567 to Kelley, Jr.; 3,147,332 to Fender; 3,249,677 to Burns, et al.; 3,236,930 to Fender; 3,571,483 to Davidson; 4,069,732 to Moskowitz, et al.; 4,133,243 to DiMarizio; 4,151,776 to Stich; 4,220,069 to Fender; and 4,222,301 to Valdez.

The electric bass has replaced the bass viol in most commercial music application because of its portability, playability, and audibility. However, many listeners, bassists, and arrangers realize the tonal quality of the electric bass is not as pleasing as that of the bass viol. Many electric bassests have switched from the fretted electric bass to the fretless electric bass to regain the expressive qualities only fretless instruments can afford the player. However, these efforts to regain such expressive qualities remain hindered by the limited range of tonal qualities offered by the variable reluctance pickups of the prior art.

Miessner, U.S. Pat. No. 1,915,858; Benioff, U.S. Pat. No. 2,239,985; Valsiach, U.S. Pat. No. 2,293,372; Cookerly, et al., U.S. Pat. Nos. 3,325,579 and 3,297,813; and Moskowitz, et al., U.S. Pat. No. 4,069,732 make use of currents magnetically induced in strings in fretted musical instruments. These configurations are also troubled by uneven string response levels and limited tonal range. In part, these problems were caused by the requirement for electrical return paths routed through the neck of the instrument in order to complete the string transducer circuit. These return paths tend to add additional impedance into the circuit and additionally act as antennas to introduce interference into the signal paths from stray fields. Furthermore, in certain of the prior configurations the interaction between strings within the circuit tended to be in opposition to one another rather than supportive thereof.

SUMMARY OF THE INVENTION

The foregoing and other problems of prior art magnetic pick-ups are overcome by the present invention which provides elongated sensing coil means positioned adjacent the string plane and transverse to the strings therein, first and second combinations of selected ones of the strings wherein the strings comprising each combination are selected so that the equivalent parameters of the first string combination are substantially similar to the equivalent parameters of the second string combination, the first and second string combinations being connected in series. Magnetic source means are also provided which define a distributed and planar magnetic pole positioned about the sensing coil which is spaced apart but parallel to the string plane. The free ends of the first and second string combinations are connected across the primary of step-up transformer means and the secondary winding of the step-up transformer means can be connected in series or in parallel with the sensing coil so that an output electric signal is provided between the free ends of the sensing coil and the secondary winding of the step-up transformer means.

Any string motion causes a current to be induced within the sensing coil and another current to be induced within the string itself. These induced currents interact with one another by way of the series or parallel connection of the sensing coil with the secondary winding of the step-up transformer means. The result is an audio signal which has variable reluctance pickup type tonality and a string current pickup with faster rise time and clearer definition for a new and distinctive tonality, all having more uniform signal levels from string to string and extended frequency response, over all degrees of string excursion.

The present invention therefore provides a unique pickup configuration which overcomes the uneven response characteristics of prior art pickups by balancing the characteristics of the strings as seen by the output circuitry in a string current transducer type pickup, and by providing a unique sensing coil and magnetic source configuration having a uniquely distributed magnetic field.

The string current transducer portion of the present invention is not susceptable to limitations of the variable reluctance pickup and string current transducers previously mentioned. The coils of conventional variable reluctance pickups are often, of necessity, high impedance. The coils cannot be effectively shielded against interference and stray fields. The signal generating mechanism of the string current transducer portion is very low impedance, typically less than five ohms; thus, interference and stray fields do not couple well into the signal source. The secondary windings of the step-up or impedance matching transformers are higher impedance but can be effectively shielded against interference and stray fields. It is envisioned that the present invention can include switchable impedance means for selection of a low or high output impedance secondary winding by way of coil tapping, for example. The high frequency response of the string current transducer is better, tonal character and touch sensitivity is closer to an acoustic instrument due in part to the fast rise time of the signal generating mechanism of the string current transducer. The faster response or rise time of the string current transducer is due to the low inductance and reactance of the signal generating portion. In prior art variable reluctance pick ups, the generation of an audio signal in response to the initial attack of a string is somewhat delayed due to an induced electromagnetic force in the pick-up coil. The faster rise time of the string current transducer gives the instrument greater definition and clarity; qualities which are desirable in ensemble playing or in playing in large rooms and under high ambient noise conditions. The player can bend or draw the strings to the maximum possible tension and not suffer loss of signal. The signal generated in each string will correspond with the acoustic motion of that string even with extreme string motion because the magnetic field used to induce currents in the strings is distributed such that it will be present during all possible string motion. The output levels from each string are more uniform due to the matching of the strings among themselves and to the step-up transformer. In the preferred embodiment the distributed magnetic field is obtained by way of distributed magnetic sources.

Within the magnetic field is the sensing coil portion which furnishes the familiar tonal quality of variable reluctance pickups. This portion of the invention features improved performance over variable reluctance pickups of the prior art, effected by the large, evenly distributed and uniquely shaped magnetic field area. The field forms a reluctance pathway wide enough to include all dynamic levels of string actuation and large enough to be operatively associated with preferably one eighth of the string length, the reluctance pathway being positioned preferably one eighth of the string length from the bridge, thus producing a signal with a natural sounding harmonic content.

The distributed magnetic field of the present invention provides for a higher output level and thus the number of turns required for the coil to produce the desired level can be reduced. This, in turn, reduces the inductance and capacitance of the coil. As a result, the high frequency response the induced noise caused by stray fields is reduced, and the coil resonance effects reduced.

The use of distributed magnetic sources also permits a larger portion of each string to be included within the portion of the field which affects the generation of a signal in the coil. As a consequence, the harmonic content of the electrical signal obtained from the coil of the present invention is richer and more complex than in conventional pickups.

A core, which is preferably of ferrous material, is disposed under the strings to form a magnetic circuit through the sensing coil. Thus, any string movement in the magnetic field induces currents in the coil thereby generating the audio signal corresponding to motion of the strings.

It is therefore an object of the present invention to provide a pickup which has greater dynamic range than prior art pickups and which is able to more faithfully respond to all string motion, including maximum excursions.

It is another object of the present invention to provide a pickup able to produce many different tonal qualities without active circuitry.

It is a further object of the invention to provide a pickup which can produce the natural sound and touch response associated with acoustic instruments, as well as the sound associated with electric instruments with coil pickups, and the combination of both sounds simultaneously.

A further object is to provide a pickup in which two sources of signal are produced as a function of the motion of strings in a common magnetic field, both signals being mixable with each other.

Another object is to provide a pickup with an output which is little affected by the variation in string height that occurs as the strings are stopped in low or high playing positions.

A still further object is to provide means for electrically connecting the strings to matching transformers which does not require a signal path other than the strings, a shorting bar and a bridge.

Still another object is to provide a pickup in which all strings respond equally when played, all strings being musically balanced with respect to loudness, frequency response and sensitivity.

The above and other objectives, features and advantages of the invention will be more readily understood upon consideration of the following detailed description of certain preferred embodiments of the invention, taken in conjunction with the accompanying drawings.

FIG. *2a* illustrates the magnet and sensing coil assembly.

FIG. *2b* is a transverse sectional view of the magnet adjustment assembly.

FIG. *3a* is a top view of the magnetic flux distribution in the magnet and coil assembly.

FIG. *3b* is an end view of the distribution of magnetic flux in magnet and coil assembly.

FIG. *3c* is a side view of the magnetic flux distribution in the magnet and coil assembly.

Figure 4:
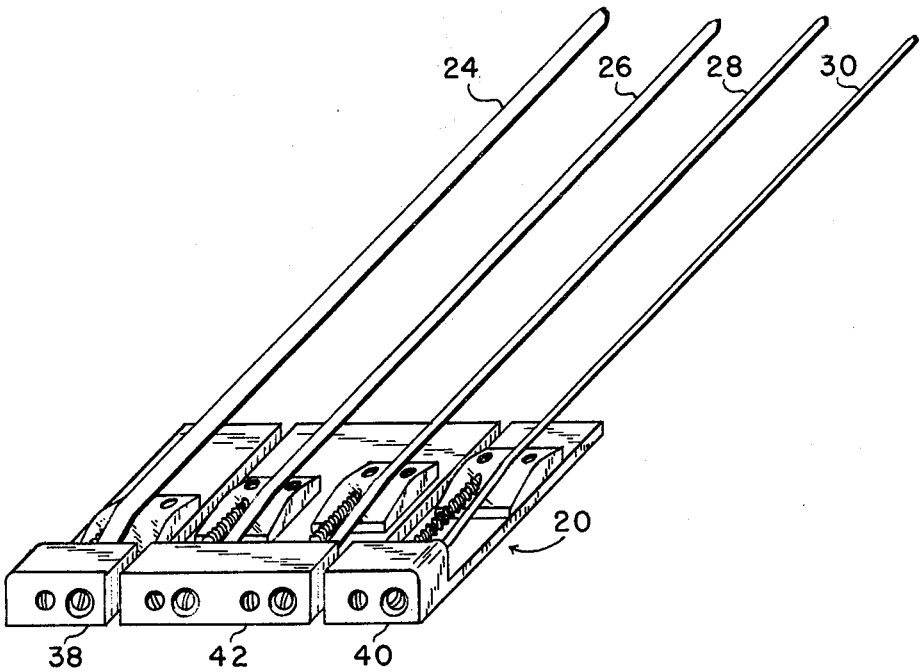

FIG. 4 illustrates the bridge assembly comprising three insulated sections.

Figure 5A:
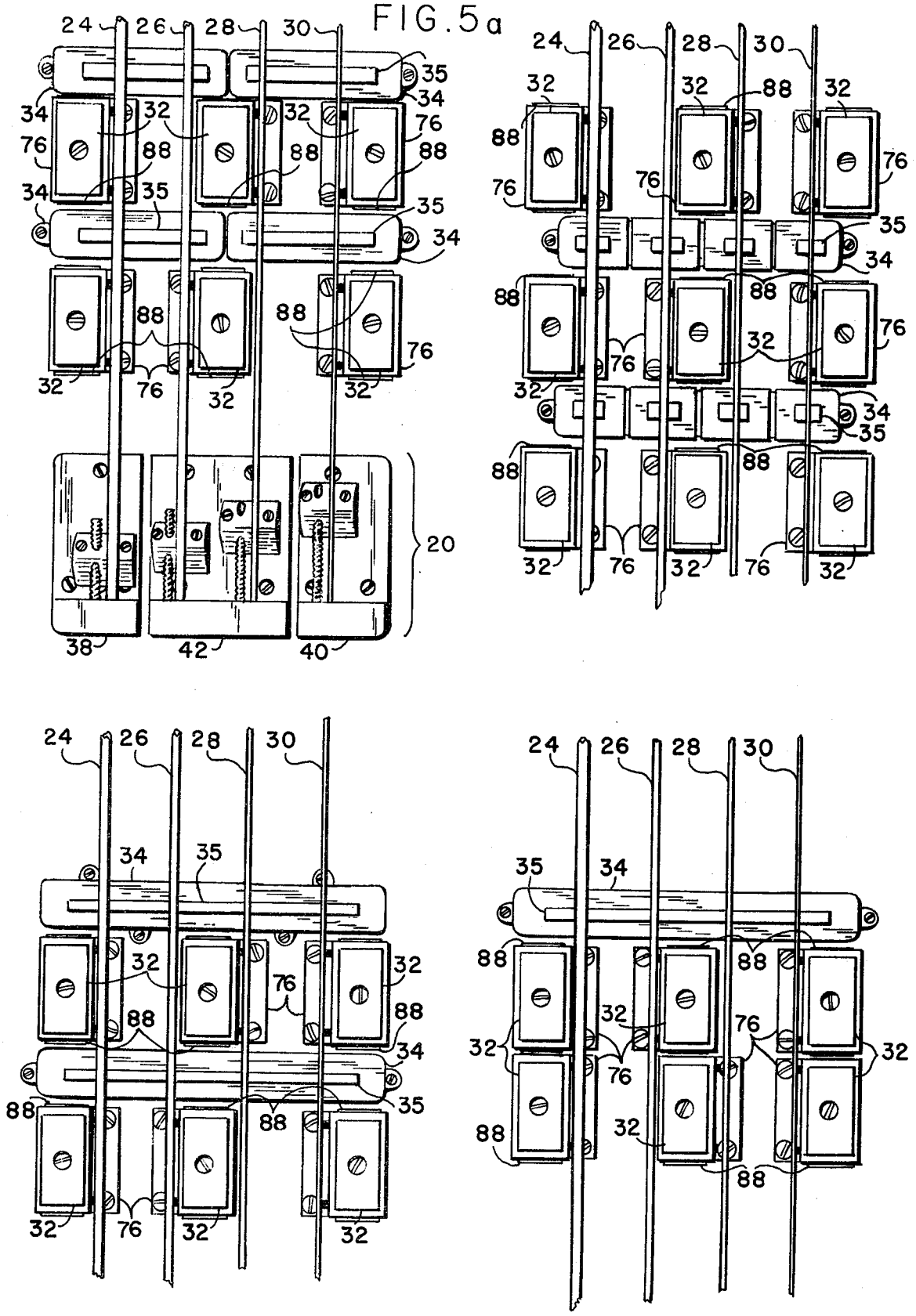
Figure 5B:
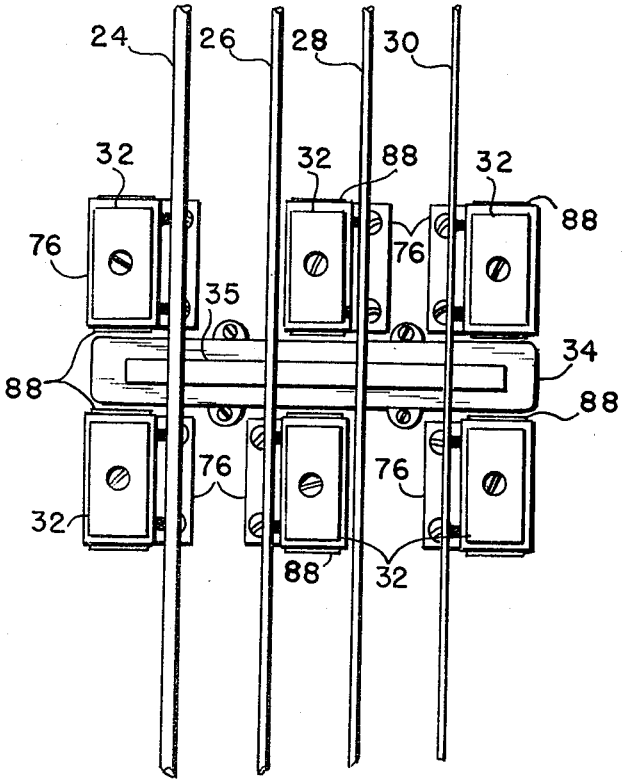

FIG. 5 illustrates a number of alternative sensing coil embodiments each utilizing different arrangements of magnets and coils.

DETAILED DESCRIPTION OF THE INVENTION

Figure 1:
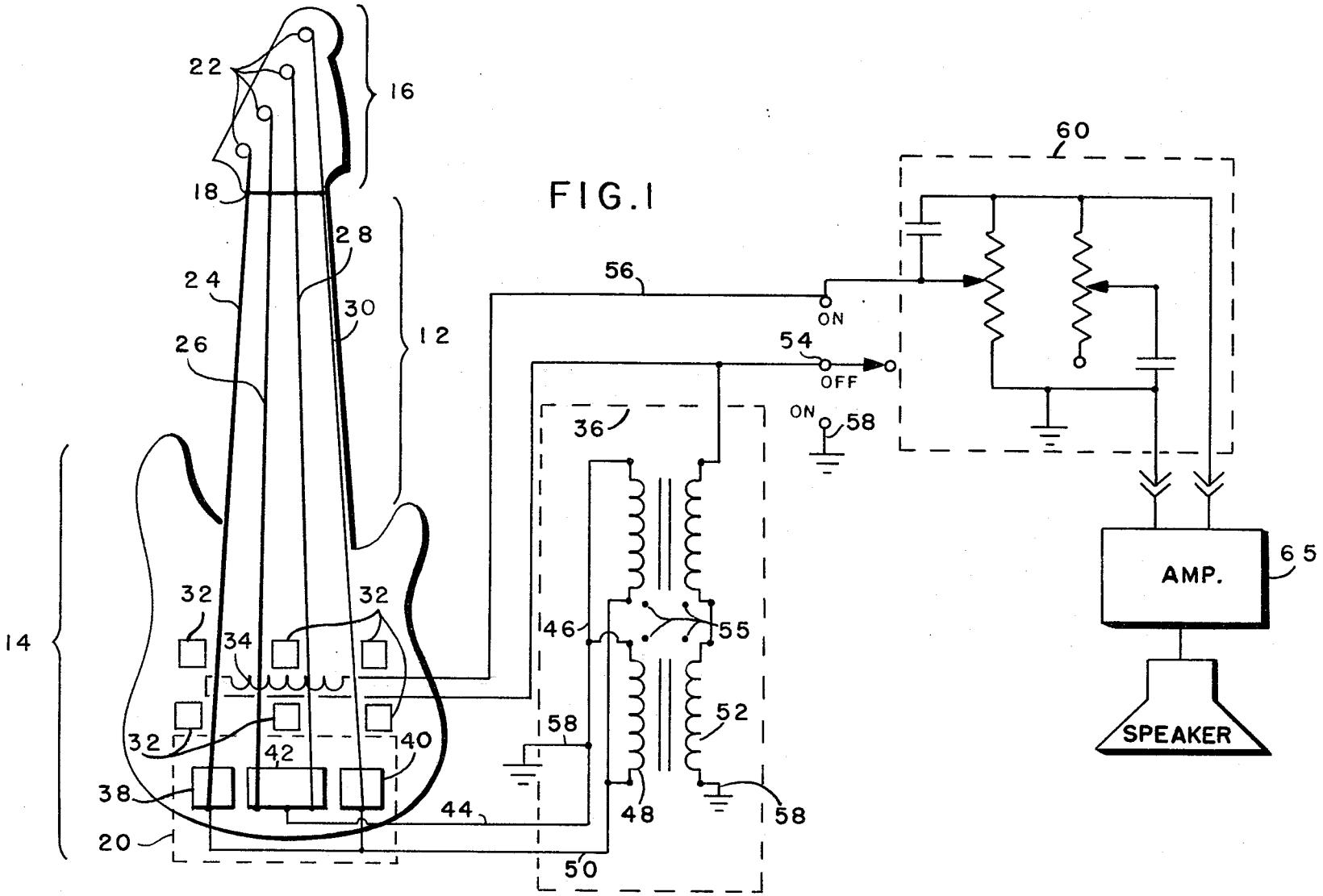
FIG. 1 is a combined pictorial and schematic drawing of the invention as used in conjunction with an electrical bass guitar.

Referring to FIG. 1, the present invention will be described by way of an illustrative example using a fretless electric bass guitar 10.

The bass guitar 10 includes a neck 12, a body 14, and a head 16. Four magnetically permeable strings are each tensioned over two permanent nodes. One of the nodes is a shorting bar 18 which is located at the junction of the head 16 and the neck 12. The other permanent node is the bridge 20 (enclosed by dotted lines ). The strings are fixedly attached at bridge 20, and in movable contact with shorting bar 18. Adjusting pins 22 are provided in the head 16 by which the tension in each string can be adjusted.

The shorting bar 18 is electrically conductive and electrically connects all four strings together. The bridge 20 is comprised of several electrically isolated sections each of which is electrically conductive. This is to permit selected ones of the four strings to be connected together.

The four strings are comprised of an E string 24, an A string 26, a D string 28 and a G string 30. These strings range from heaviest to lightest, respectively, with the E string 24 producing the lowest notes and the G string 30 producing the highest notes. Each of the strings has a different total mass, resistivity, coercivity, permeability, and reluctance. These properties affect the audio output obtained from each string; i.e., the thinner strings being more magnetizable and generating stronger audio signals than the thicker strings.

Disposed below, but not directly beneath, the strings are a plurality of magnets 32. These magnets provide the magnetic field by which electrical currents are induced in response to string motion.

Positioned among the magnets 32 is a sensing coil 34 which forms one portion of the magnetic circuit of the present invention.

As discussed above, the bridge 20 is provided with a number of electrically isolated conductive sections which permit the interconnection of selected ones of the four strings. It is by way of this selective interconnection of such strings that the effects of the electrical differences between the strings are minimized and the audio response of each string is thereby made uniform.

In the illustrative example of the fretless electric bass 10, the previously mentioned differences between strings are minimized by the parallel connection of the heaviest E string 24 to the lightest G string 30. The A string 26 and the D string 28 are likewise connected in parallel. The parallel combination of the E string 24 and the G string 30 and the parallel combination of the A string 26 and the D string 28 are then connected in series via shorting bar 18. This series connection of the parallel combinations is then connected across a step-up transformer 36 (enclosed by dotted lines).

In order to effect the above parallel connections at the bridge 20, the E string is connected to an isolated conductive section 38, while the G string is connected to a different isolated conductive section 40 (see FIG. 4). Conversely, the A string 26 and the D string 28 are both connected to the same isolated conductive section 42. An electrical connection 44 is thereafter provided between isolated conductive section 42 and one end 46 of the primary winding 48 of the step-up transformer 36. Isolated conductive sections 38 and 40 are connected to the other terminal 50 of the primary winding 48 of step-up transformer 36.

By positioning step-up transformer 38 in close proximity to the bridge 20, the impedance of the electrical connections between the bridge and the primary winding 48, of the step-up transformer 36 can be kept small and the effect of such electrical connections on the performance of the pickup thereby minimized.

It should be noted at this point that due to the unique interconnection of the strings, there are no additional return or auxilliary connections required between the strings and the output circuitry as was the case with numerous of the prior art pick-up configurations. Additionally, the serial connection of the two string combinations at the shorting bar 18 keeps the signal paths small and has been found to aid in the inducement of currents in the strings. Thus the conductive path of the string current transducer circuit is limited to the strings, the shorting bar 18 connection, the step-up transformer 36, and the bridge 20 connections.

It has been found that the interconnection of the strings in the configuration described above minimizes the different characteristics of strings of different diameters and presents a more uniform load to the output circuitry, i.e. the step-up transformer. As a result, the audio output of each string matches the audio output of the other strings with respect to loudness, frequency response, and sensitivity. These qualities combine to make the instrument enjoyable to play and hear.

In the string bass example, the E and G strings are connected in parallel to form one string combination and the A and D strings are connected in parallel to form a second string combination. It has been found that for the electric string bass the above string combinations provide the best results. It is to be understood that the string combinations for different instrument type can differ. Therefore, for a particular instrument type selection of the particular strings to be included in each combination should be based upon which combination of strings provide the most similarity between the effective characteristics of each combination of strings.

U.S. Pat. No. 4,269,103 to Underwood and U.S. Pat. No. 3,177,283 to Fender appear to be directed to adjusting the response differences in strings of different types; however, these patents appear to be directed to signals generated in coil pick-ups, rather than by the strings themselves. U.S. Pat. No. 4,069,732 to Moskowitz appears to be directed to adjusting the differences in the output signals generated by the different strings; however, the technique employed by Moskowitz appears to utilize the concept of dissipating excess signal levels, rather than redistributing the string load as is the technique employed by the present invention. Apparently, Moskowitz uses shunting resistors in parallel with certain of the strings. This method is not desirable because, in addition to signal dissipation effects, these adjustments will have to be re-set each time new strings of a slightly different gauge, type or brand were applied to the instrument. The shunting resistor also appears to load the signal generating circuit with resistance that is not part of the signal producing string, thus attenuating the overall signal output levels.

Returning to FIG. 1, the preferred embodiment of the step-up transformer 36 will now be described. Preferably, the primary winding 48 has a very low impedance, typically less than 5 ohms. Conversely, the secondary winding 52 has an output impedance which is selected to provide the standard output impedance required for typical musical instrument amplifiers, normally 10,000 ohms. The impedance of the secondary winding can be made to be either high or low impedance by the usual coil tapping arrangement. Furthermore, the high or low impedance state can be switchably selected by use of an appropriate switch, such as a double pole switch. As the name implies, the step-up transformer 36 acts to increase the signal level from the primary winding 48 to the secondary winding 52. Thus, the turns ratio to the primary to the secondary is preferably very large, typically 1:90.

It has been found that commercially available step-up transformers do not presently provide, in a single transformer, the required low impedance primary winding. It has been discovered that connection of two transformers in the manner illustrated in FIG. 1 provides such a low impedance and, as an additional benefit, can be wired to greatly reduce spurious induced noise. As shown in FIG. 1, the primary winding 48 of the step-up transformer 36 is formed by connecting the primary windings of two step-up transformers in parallel. Conversely, the secondary windings of the step-up transformers are connected in series. In this manner, the effective primary winding impedance is reduced and the output signal from the secondary winding 52 is increased. As can be seen in FIG. 1, in order to reduce spurious noise, the secondary windings and the primary windings of the two step-up transformers are connected in an opposing phase arrangement as indicated by the phasing dots 55. While the preferred embodiment of step-up transformer 36 involves parallel connection of two step-up transformers, it is to be understood that any step-up transformer which provides a very low impedance primary winding and a high impedance secondary winding and which further provides the required step-up ratio is satisfactory for the present invention. However, for best signal to noise ratio, such a transformer should have means for connection in the hum cancelling manner.

As can be seen from FIG. 1, the sensing coil 34 is connected in series with the secondary winding 52 of the step-up transformer 36. In this manner, the current induced within the sensing coil 34 and within the secondary winding 52 interact to produce a unique and musically pleasant audio output. In order to accomplish this, the impedance of sensing coil 34 is selected to be approximately equal to the impedance of secondary winding 52. In this manner, the loading effects of the sensing coil 34 on the secondary winding 52 are minimized and vice versa.

The wiper of a three-position switch is connected to the junction between sensing coil 34 and secondary winding 52. One terminal of the switch is connected to the free end 56 of the sensing coil, while another terminal of the switch is connected to the free end of secondary winding 52 via circuit common 58. The third terminal is left unconnected. In this manner, the wiper can be connected to bypass the output of the sensing coil 34 when only the output of the string current transducer is desired to be heard. Conversely, the wiper can be connected across the output of the secondary winding 52 to bypass the string current ransducer signal whenever the sensing coil signal alone is sought to be heard. When the contact is in the unconnected position, the outputs of both the sensing coil and the string current transducer are combined to provide the audio output. These two outputs can be combined in the additive (in phase) or cancelling (out of phase) mode by appropriate switching (not shown). In the preferred embodiment, the outputs are connected in series, or the additive mode. The circuitry enclosed by dotted lines 60 are the conventional passive controls for use by the guitar player in shaping the signal before transmission to the amplifier. Double arrows 25 represent the co-axial cable connection between the bass guitar 10 and musical instrument amplifier 62. Typically, this co-axial cable connection can be fairly long, extending at least 20 feet. This long transmission distance has, in part, been responsible for the requirement of a fairly large output signal from magnetic pick-up means. As discussed above, it has sometimes been the case that preamplifiers within the electrical instrument itself were required in order to provide such output levels. In the case of the present invention, the circuit configuration provides sufficient output to passively transmit an audio signal through an appreciable length of cable.

Figure 2A:
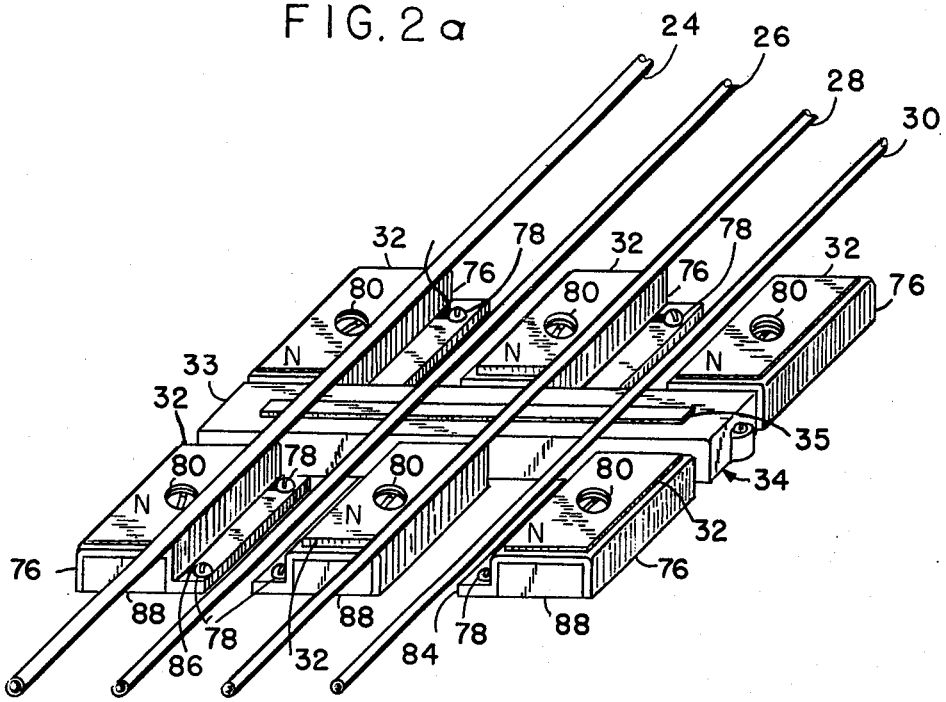
Figure 2B:
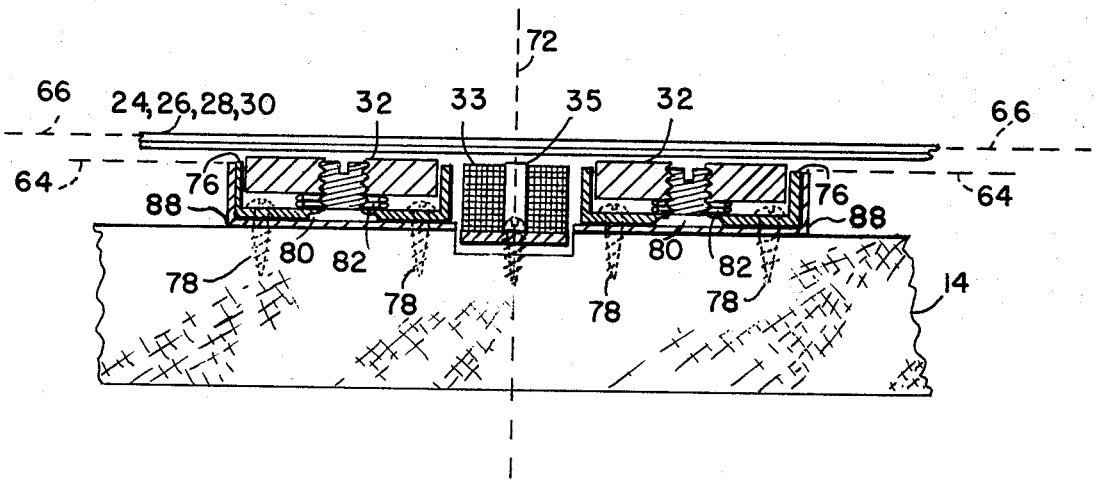
Figure 3A:
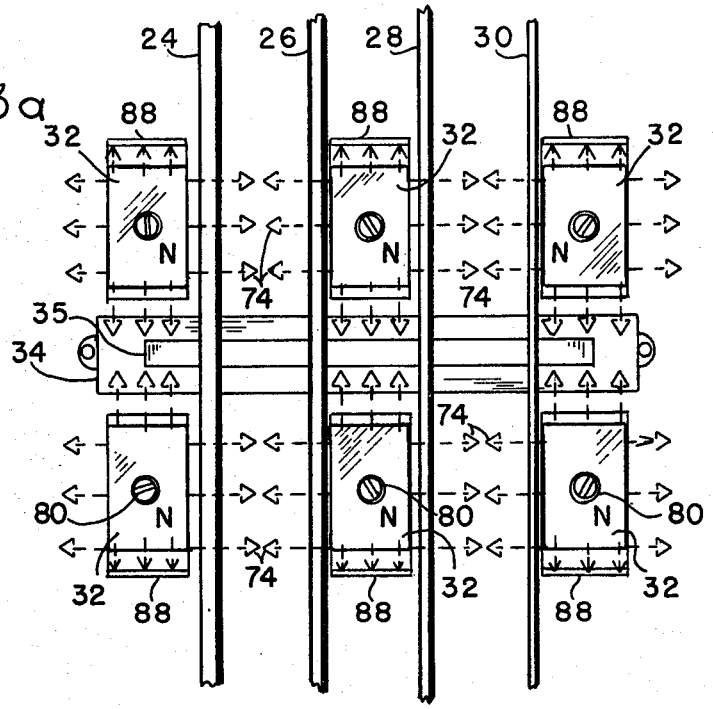

Referring to FIGS. 2A, 2B and 3A, the orientation of the magnets 32 with respect to sensing coil 34 and strings 24, 26, 28 and 30 will now be described in greater detail. In the preferred embodiment of the present invention, six planar magnets are utilized. The magnets can be ceramic, alnico, or any other magnetic field source. Each magnet has a planar surface which defines a north pole and another planar surface which defines a south pole. The magnets are each positioned to have the same polar relationship to the strings.

The sensing coil 34 has an elongated surface 33 which is disposed transverse to the strings. Contained within the sensing coil 34 is a core 35 of ferrous material with low retentivity which acts to form a magnetic path through the coil 34.

Three magnets each are disposed on either side of the coil 34. As can be seen from FIG. 2B, the upper surfaces of the coil and magnets are disposed in substantially the same plane, indicated by dotted lines 64. This plane is substantially parallel to the string plane, indicated by dotted lines 66. As used herein, the string plane is a plane which contains the four strings.

As can be seen from FIG. 3A, unlike prior art magnetic pick-ups, the magnets of the present invention are not disposed directly beneath each string. Instead, the magnets are disposed to the sides of the strings. Thus, with respect to hypothetical planes, each of which contains a string and each of which is orthogonal to the string plane, the magnets would be located either between these orthogonal or to one side of an orthogonal plane. Thus, in FIG. 3A, a top view of the magnets, coils and strings, it can be seen that two of the magnets 32 are disposed to the left of E string 24. Two different magnets 32 are disposed between A string 26 and D string 28. Finally, the remaining two magnets are disposed to the right of D string 30.

Thus, it can be seen from FIGS. 2A, 2B and 3A, the magnets are positioned with respect to the string planes, such that the north pole of each magnet faces the string plane. The south pole of each magnet, therefore, faces away from the string plane.

Coil 34 is constructed by winding a multiplicity of turns of fine insulated conductive wire, such as copper, around an insulated bobbin. In the preferred embodiment of the present invention, the coil 34 has an elongated cross-sectional area. FIG. 3C provides an end view of the coil. There, the bobbin 68 can be seen around which the wire 70 has been wound. It should be noted that each loop of wire lies in a plane which is parallel to the string plane 66. Additionally, the ferrous core 35 can be seen disposed in the coil 34 so that the core 35 extends through the center of the coil along an axis 72 which is perpendicular to the string plane 66. The coil 34 thus provides a multiplicity of loops, the passage of a varying magnetic flux through which will induce an electrical current flow which is proportional to the variation of the magnetic flux therethrough.

As discussed above, the distributed magnetic field provided in the present invention permits the use of coils having significantly fewer turns than most conventional variable reluctance coils. As a result, the resistance, inductance and capacitance of the coil 34 are significantly lower. Thus, the high frequency response of the coil 34 is enhanced, and the coil resonance is shifted. Because the resistance of the coil 34 is lower, there is also less noise and interference coupled into the signal loop. Typical conventional coil D.C. resistances are in the 10 K ohm range while the coil of the present invention can have a D.C. resistance of 2 K ohms.

It is envisioned that more than one coil can be used and that in the case of a two coil system, one of the coils can be wound in the opposite direction from the other coil, thus providing a hum cancelling arrangement.

It is further envisioned that the impedance of the coils can be selected to be high or low by appropriate switching and coil tapping.

Figure 3B:
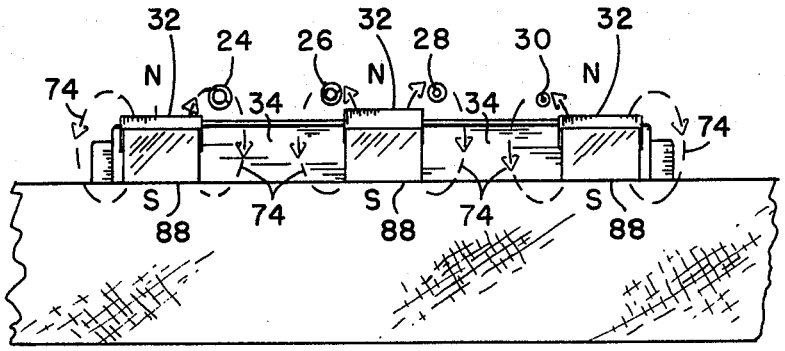
Figure 3C:
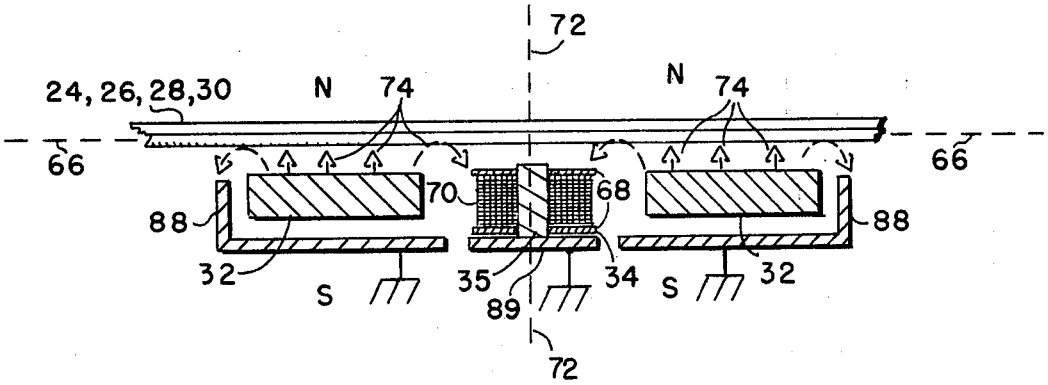

The magnets 32, coil 34, and strings 24, 26, 28 and 30 form a magnetic circuit which is generally shown in FIG. 3A, 3B and 3C. FIG. 3B and 3C illustrate the magnetic field which is formed with respect to the sensing coil 34. Dotted line 74 designate lines of magnetic flux and the arrowheads thereon indicate the direction of the magnetic flux. From FIG. 3B, it can be seen that the magnetic flux lines 74 flow from the top of each magnet 32 through one of the strings, for example 24, down through the coil 34, and back to the south pole of the magnet 32. From FIG. 3C, the core 35 can be seen to provide a low reluctance magnetic path which causes the lines of magnetic flux to be directed toward and through the center of coil 34. In this manner, the concentration of magnetic flux lines which pass through the coil 34 is greatly increased. According to magnetic theory, any movement of a magnetically permeable material within a magnetic field causes variations in the magnetic field. Thus, any string movement causes perturbations in the magnetic field line 74 which are proportional to the vibration of the strings. Again, according to magnetic theory, a varying magnetic field through a loop of wire causes an electric current to be induced within the loop of wire. Thus, because the magnetic field passing through the coil 34 is perturbated by the string movement, currents are induced within the coil which are proportional to the string movement. Thus, string motion is converted into an electrical signal.

The coil 34 and magnet 32 configuration provided by the present invention permits superior performance over variable reluctance pick-ups of the past. This is because the magnet positions, shown in FIG. 3A, provide a uniquely distributed magnetic field which is uniform throughout substantially all possible excursions of each string and over a large string area. Even if the player "stops" the strings in both the high and low positions, the magnitude of the resulting output signal remains surprisingly consistent. Additionally, the distribution of the magnetic field provided by the present invention permits the magnetic field to be uniquely shaped according to a user's discretion, or to compensate for variations in string characteristics.

An additional benefit of the distributed magnetic field is that a greater length of each string is permitted to interact with the magnetic flux lines of the magnetic field. This in turn permits a greater range of harmonic motion of each string to be transformed into the output electrical signal. Thus, the harmonic content produced by the present invention is significantly greater than when a single conventional magnetic pick-up is used, and can have as great a harmonic content as when four conventional magnetic pick-ups are used.

It should be noted that, unlike prior art variable reluctance pickups in which direct contact between magnetic material, ferrous core, and the coil itself is always present, the magnets of the present invention are physically separated from the coil. Thus, the physical position of the various magnets can be changed independently and separately from the coil structure for fine adjustment of the field shape for uniform output.

Means are illustrated in FIGS. 2A and 2B by which separate adjustment of each magnet can be achieved. Additionally, it is important to the present invention that vibration of the magnets be prevented, in order to avoid microphonic effects. In the preferred embodiment of the invention, the magnets are inserted into plastic-mounting enclosures 76 which act to solidly secure the magnets 32 to the instrument body. These plastic-mounting enclosures 76 can be molded of "Lexan" or other resilient plastic. Mounting screws 78 are used to secure the enclosure to the body 14.

The magnets 32 are attached to enclosure 76 by means of a threaded post/coil spring configuration. Threaded post 80 is shown having one end threaded into magnet 32 and with other end rotatably fastened to the enclosure 76. Coil spring 82 is disposed between magnet 32 and enclosure 76 so that threaded post 80 passes through the center of coil spring 82. Coil spring 82 can be made of heavy spring steel and provides support for the magnet and exerts pressure between the magnet 32 and enclosure 76 to physically stabilize the magnet. Each magnet 32 is adjustable as to vertical height by turning threaded post 80 in a clockwise or counter-clockwise direction.

Enclosure 76 also includes a lip 84, FIG. 2A, by which screws 78 secure the enclosure 76 to the body of the guitar 14. Screws 78 pass through slots 86 in the lip. The slots 86 are shaped so that the enclosure 76 can be moved back and forth transversely with respect to the strings so that each magnet can be separately positioned with respect to the strings as desired.

The magnetic circuit, with respect to the string current transducer portion of the present invention, can be best appreciated upon reviewing FIGS. 3A and 3B. Recall that E string 24 and G string 30 are connected in parallel as are A string 26 and D string 28. All of the strings are electrically connected at the shorting bar 18, but selectively connected at the bridge 20. Due to this configuration, when a string plucked, for instance the E string 24, the inductive magnetic loop which is formed involves E string 24 and the parallel combination A string 26 and D string 28. Thus, the magnets 32 disposed adjacent E string 24 and between A string 26 and D string 28 provide the magnetic field which induces the current within the E string. As can be seen from FIG. 3B as E string 24 moves back and forth, the number of flux lines included within the loop form by E string 24 and the parallel combination of A string 26 and D string 28 increases and decreases as the E string 24 moves back and forth in the string plane. Similarly, as E string 24 moves vertically with respect to the string plane, a varying number of flux lines are included within the corresponding conductive loop. Thus, an electric current is induced within E string 24 which is proportional to the E string movement. As with the variable reluctance portion of the present invention, the distribution of magnets provides a uniform field strength for substantially all anticipated string positions for the string current transducer, thus providing for response to a wide dynamic range of string motion.

Experimentation and actual performance trials reveal that the best results are achieved by a magnetic field, the effective size of which is no greater than one-eighth the string length. The magnetic fields should be strong enough to induce sufficient current in moving strings to inductively couple to and passively drive a convenient length of cable as is necessary in the normal operation of electric string instruments.

It should be noted that the magnetic field strength can become a source of interference with string motion. In the invention, this problem is overcome by mounting the magnetic field and coil assembly, preferrably no further than one-eighth of the string length from the bridge 20. Greater magnetic force than is present in the preferred embodiment of the invention is required before interference or the dampening of string motion will occur at this position. An added benefit of this position is a richer harmonic content, i.e., more upper partials than in other positions.

FIG. 5 illustrates alternate embodiments of the present invention in which additional sensing coils are provided to sense different positions along the string plane. This permits greater frequency content in the output. However, the basic technique of the present invention remains the same.

The method of the present invention involves, first of all, positioning and distributing a planar magnetic field with respect to the string plane and sensing coil position so that the magnetic source is positioned between and adjacent to, as opposed to directly under, the strings and providing adjustment means by which the elevation of the magnets with respect to the strings can be varied as required so that the physical parameters of each string can be compensated for to provide a balanced response for each string. The method also includes the selective connection of certain ones of the strings in the string plane in parallel, and then the series connection of such combination so that the physical differences between each string are equalized. In a specific embodiment of the present invention, the method includes the steps of connecting the E string and G string together and the A string and D string together. The method further includes the steps of providing a step-up transformer which has a very low primary winding impedance and a substantially higher secondary winding impedance.

While the present invention has been discussed with connection with a bass guitar, it is to be understood that the techniques involved are equally applicable to any string instrument where the strings are of magnetically permeable material.

The strings of the instrument need not be constructed totally of magnetically permeable material. The strings can have a nylon or brass wrapping, for example, with a core of permeable metal. The basic requirement of the invention is that the string material have the property that the movement of such material in a magnetic field cause significant pertubation of the field.

Additionally, it is to be understood that the invention is equally applicable to fretted instruments where such frets are constructed of non-conductive or high resistance materials.

Referring to FIG. 3C, an alternative embodiment of the sensing coil 34, magnetic circuit configuration is shown. There, a magnetically permeable piece 88 which is electrically connected to ground is added to further shape the magnetic field beneath the magnets 32 and coil 34. Provision of such shaping surface concentrates the flux in the area operatively associated with the strings and coils. Additionally this reduces the effect of external fields upon the magnetic structure, as the shaping surfaces are electrically connected to ground. The field shaping surface includes a core extension 89 which is in physical contact with the coil 35.

The terms and expressions which have been employed here are used as terms of description, and not of limitation, and there is no intention, in the use of such terms and expressions of excluding of equivalents of the features shown and described, or portions thereof, it being recognized that various modifications are possible within the scope of the invention claimed.

What is claimed is:

1. Apparatus for use in stringed musical instruments, of the type having a plurality of strings which are positioned parallel to one another in a common string plane wherein the strings have a maximum excursion, for converting string motion into electrical signals, comprising sensing coil means positioned with central axis perpendicular to the string plane, the coil means defining elongated top and bottom surfaces which are perpendicular to the principle axis of the coil means and which each cover a predetermined surface area, wherein the bottom surface is disposed transversely to the strings and lies in a first plane which is spaced apart from the string plane, and further wherein the top surface is aligned with the bottom surface and lies in a second plane which is spaced apart from the string plane and positioned between the string plane and the first plane;

magnetic source means positioned about but spaced apart from the coil means, having an upper planar surface which defines a magnetic pole and a lower planar surface which defines an opposite magnetic pole, wherein the upper planar surface is positioned generally within the second plane and the lower planar surface is positioned generally within the first plane, the upper and lower planar surfaces each having an area substantially larger than the surface area of the top or the bottom surface of the coil means; and elongated core means encompassed by the coil means and extending through the top and bottom surfaces of the coil, the core means comprising magnetically permeable material so that an effective magnetic field is formed which extends from the upper planar surface, through the strings, and thence through the core means and to the lower planar surface, the effective magnetic field having a volume in the region of the string plane which is greater than the volume occupied by the strings during maximum string excursion.

2. The apparatus as recited in claim 1 wherein the magnetic source means comprise a plurality of planar magnets, each having a planar face defining a north pole and a planar face defining a south pole, wherein the corresponding face of each magnet is positioned in a common plane to define one magnetic pole of the magnetic source means, each magnet being positioned between vertical planes, orthogonal to the string plane, which contain each string.

3. The apparatus as recited in claim 2 wherein the musical instrument has first, second, third, and fourth strings arranged generally parallel to one another in the string plane and spaced apart from each other, and furtherwherein a first one of the plurality of planar magnets is positioned to the left of the orthogonal plane of the first string, a second one of the plurality of magnets is positioned between the orthogonal planes of the second and third strings, and a third one of the plurality of magnets is positioned to the right of the orthogonal plane of the fourth string.

4. The apparatus as recited in claim 1 wherein the strings have a predetermined length and furtherwherein the effective size of the magnetic field defined by the planar surfaces is no greater than approximately one-eighth of the string length.

5. The apparatus as recited in claim 1 wherein the musical instrument has a neck which is connected in a common plane to a body, and one end of the strings are attached to the free end of the neck, and the other end of the strings is attached to the body by bridge means, so that the strings extend between the bridge means and the free end of the neck over a predetermined distance; and furtherwherein the coil means and the magnetic source means are positioned from the bridge means no greater than one-eighth of the distance between the bridge means and the free end of the neck.

6. The apparatus as recited in claims 1 or 2 wherein the magnetic source means include mounting means which permit the distance between the string plane and the upper planar surface of the magnetic source means to be varied.

7. The apparatus as recited in claim 2 wherein each magnet is attached to the musical instrument by mounting means, wherein the mounting means permit the distance between the string plane and the planar face of each magnet to be varied independently so that the distribution of the magnetic field, as defined by the magnets, with respect to the string plane can be shaped.

8. The apparatus as recited in claim 7 wherein the mounting means include support means for preventing magnet vibration; the support means being constructed of a resilient plastic and positioned between the magnet and the musical instrument and furtherwherein rotatable threaded post means are provided to connect each magnet to the corresponding support means so that the distance between the string plane and the upper planar surface of each magnet can be adjusted by suitable rotation of the threaded post means.

9. The apparatus as recited in claims 1 or 2 wherein the magnetic source means include side surfaces that are generally orthogonal to the string plane which connect the upper planar surface to the lower planar surfaces, certain ones of the side surfaces lying generally parallel to the transverse axis of the coil means and furthest removed therefrom, the apparatus further including field shaping means positioned adjacent to but spaced apart from the lower planar surfaces and the side surfaces which lie generally parallel to the transverse axis of the coil means and which are furthest removed from the coil means, so that the magnetic field is concentrated in the area operatively associated with the string plane and the coil means.

10. The apparatus of claim 9 wherein the upper planar surface of the magnetic source is distributed about the coil means, and furtherwherein the portion of the field shaping means adjacent the lower planar surfaces of the magnetic source means are contained within a common plane, the field shaping means further including core extension means which lie generally in the common plane and which are positioned adjacent the bottom surface defined by the coil means and in contact with the core means.

11. The apparatus of claim 1 wherein the magnetic source means comprise ceramic magnets.

12. The apparatus of claim 1 wherein the magnetic source means comprise alnico magnets.

13. The apparatus of claim 7 wherein the mounting means further include lateral adjustment means so that the position of each magnet can be adjusted within a plane parallel to the string plane.

14. The apparatus of claim 2 wherein the core means are constructed of material having low magnetic retentivity.

15. The apparatus of claim 2 wherein the coil means comprise a multiplicity of turns of insulated conductive wire which are wound about an insulated bobbin.

16. Apparatus for use in a stringed musical instrument having a plurality of strings generally parallel to one another and lying within a string plane for converting string motion to electrical signals, comprising step-up transformer means having a low impedance primary winding and a substantially higher impedance secondary winding;

a first combination of strings connected in parallel and having a set of equivalent parameters including resistance, mass, permeability, reluctance and inductive reactance;

a second combination of strings connected in parallel and having equivalent parameters including resistance, mass, permeability, reluctance and coercivity, the first and second combination of strings being each extended between a first node and a second node, the first and second combination of strings being electrically connected to one another at the first node so that the first combination is connected in series with the second combination, wherein the series connection of the first and second combinations is electrically connected at the second node across the primary winding of the step-up transformer; and magnetic source means having a planar surface which defines a magnetic pole, the planar surface being positioned in close proximity to the string plane and having an effective area which extends beyond the area covered by a maximum string excursion, wherein the equivalent parameters of the first string combination are substantially the same as that for the second string combination.

17. The apparatus, as recited in claim 16, wherein the equivalent resistance of the first and second string combinations as seen by the primary winding of the step-up transformer is of the same magnitude as the resistance of the primary winding.

18. The apparatus, as recited in claims 16 and 17, wherein the resistance of the primary winding of the step-up transformer is less than five ohms.

19. The apparatus, as recited in claim 17, wherein the first node is a shorting bar which electrically connects one end of the first string combination to the corresponding end of the second string combination.

20. The apparatus, as recited in claim 16, wherein the second node comprises bridge means including a plurality of electrically isolated sections, with the first string combination connected to a selected section and the second string combination being connected to different selected sections, so that electrical isolation between the first string combination and the second string combination can be maintained at the second node.

21. The apparatus, as recited in claim 16, wherein the magnetic source means comprise a plurality of magnets, each magnet having an upper planar surface which defines a magnetic pole and a lower planar surface which defines an opposite magnetic pole, wherein the magnets are disposed so that the upper planar surfaces in combination define the planar surface of the magnetic source means, and furtherwherein each magnet is positioned between planes which are orthogonal to the string plane and which each contain one of the plurality of strings.

22. The apparatus, as recited in claim 21, wherein the musical instrument is a fretless string bass and the plurality of strings comprise an E string, an A string, a D string, and a G string, all of standard thickness, and furtherwherein the first string combination includes the E string and the G string, and the second string combination includes the A string and the D string.

23. The apparatus, as recited in claim 22, wherein one of the plurality of magnets is positioned adjacent the orthogonal plane containing the E string, and a second one of the plurality of magnets is positioned adjacent the orthogonal plane containing the G string, and a third one of the plurality of magnets is positioned between the orthogonal planes containing the A and D strings.

24. The apparatus, as recited in claim 16, wherein the step-up transformer means comprises a first step-up transformer and a second step-up transformer, each having a low resistance primary winding and a high resistance secondary winding, the primary windings of the first and second step-up transformers connected in parallel with one another, and the secondary windings of the first and second step-up transformers connected in series with one another.

25. The apparatus, as recited in claim 24, wherein the primary winding and the secondary winding of the first and second step-up transformers each have a predetermined phasing, and furtherwherein, the primary windings of the first and second step-up transformers are connected to be out-of-phase with each other, and the secondary windings of the first and second step-up transformers are connected to be out-of-phase with each other.

26. The apparatus, as recited in claim 16, wherein the musical instrument is a string bass having a neck and a body and the plurality of strings include an E string, an A string, a D string and a G string, and the strings are tensioned between a first node and a second node, the first node positioned on the neck and providing electrical connection between the strings connected thereto, and furtherwherein the second node is positioned on the body and comprises a plurality of electrically isolated sections, the E string being connected to a first one of the isolated sections, the A and D strings being connected to a second one of the isolated sections, and the G string being connected to a third one of the isolated sections, the first and third isolated sections being connected to one end of the primary winding of the step-up transformer means and the second isolated section being connected to the other end of the primary winding, so that the first string combination comprises the E and G strings and the second string combination comprises the A and D strings.

27. The apparatus, as recited in claim 16, wherein the musical instrument is a string bass having four strings each having a mass, and furtherwherein the first string combination comprises the string having the largest mass and the string having the smallest mass, and the second string combination comprises the remaining strings.

28. A method of converting string motion into an electrical signal in a stringed musical instrument having a plurality of strings positioned generally parallel to one another in a common string plane and tensioned between a first node and a second node, each string having physical parameters including mass, resistance, permeability, reluctance, and inductive reactance, the method comprising the steps of connecting selected ones of the plurality of strings in parallel to form a first string combination having an equivalent mass;

connecting the remaining strings of the plurality of strings in parallel to form a second string combination having an equivalent mass, the strings of the first string combination being selected so that the equivalent mass of the second string combination is substantially similar to the equivalent mass of the first string combination;

providing an electrical connection between all strings of the plurality of strings at the first node, so that the first string combination is connected in series with the second string combination as seen from the second node;

positioning a magnetic source means adjacent to the string plane, the magnetic source means having a planar surface which defines a magnetic pole, the planar surface positioned parallel to the string plane but apart therefrom, so that vibration of the strings causes an electrical current to be induced in the string and an electrical voltage to be induced across the string; and connecting the series combination of the first string combination and the second string combination across a primary winding of a step-up transformer, the primary winding having a low impedance and the step-up transformer having a secondary winding with a high impedance, so that the electrical voltage induced in any of the strings is increased to a magnitude suitable for use in a standard musical instrument amplifier.

29. The method, as recited in claim 28, wherein the magnetic source means include a plurality of planar magnets, each magnet having a planar surface defining a magnetic pole and furtherwherein the magnetic source means positioning step comprises the step of positioning each magnet between hypothetical planes which are orthogonal to the string plane and which each include one of the plurality of strings.

30. The method of claim 28 wherein the steps of selecting the first string combination and the second string combination further include the step of selecting the first string combination so that the equivalent resistance, permeability, reluctance, and inductive reactance of the second string combination is substantially the same as the equivalent resistance, permeability, reluctance and inductive reactance of the first string combination.

31. Apparatus for converting string motion to an electrical signal in a stringed musical instrument having a plurality of strings which are positioned generally parallel to one another in a string plane, the apparatus comprising sensing coil means positioned adjacent the string plane;

a first string combination of selected ones of the plurality of strings;

a second string combination of selected ones of the plurality of strings, the first string combination being selected so that the equivalent mass of the first string combination is substantially similar to the equivalent mass of the second string combination;

means for connecting the first string combination in series with the second string combination;

step-up transformer means having a low impedance primary winding and a higher impedance secondary winding, wherein the series connection of the first and second string combination is connected across the primary winding; and planar magnetic source means for generating a broad area magnetic field, the magnetic source means having a planar surface defining a magnetic pole which is positioned adjacent the string plane and in alignment with the sensing coil means;

wherein the sensing coil means are connected in series with the secondary winding of the step-up transformer, so that movement of the strings within the magnetic field induces a first current flow within the sensing coil means and a second current flow in the step-up transformer means such that a resultant current is produced through the series combination of the sensing coil means and the secondary winding of the step-up transformer which is an interactive combination of the first and second current flows, and furtherwherein the resultant current flow is provided as the output electrical signal.

32. The apparatus, as recited in claim 31, further including switch means connected to the secondary winding of the step-up transformer means and the sensing coil means for selectively by-passing either the sensing coil means or the secondary winding of the step-up transformer means, so that the output of the apparatus can be the first current flow of the sensing coil means alone, the second current flow of the step-up transformer means alone, or the resultant current flow of the series connected sensing coil means and step-up transformer means.

* * * * *